US005430917A

United States Patent [19]

Inagaki et al.

[11] Patent Number: 5,430,917

[45] Date of Patent: Jul. 11, 1995

[54] METHOD AND APPARATUS FOR PIECING LAP SHEETS

[75] Inventors: Kazuhiro Inagaki, Kuwana; Osamu Terao, Yottsukaichi; Katsutoshi Kishi, Hashima, all of Japan

[73] Assignee: Howa Machinery, Ltd., Japan

[21] Appl. No.: 158,529

[22] Filed: Nov. 29, 1993

[30] Foreign Application Priority Data

Dec. 11, 1992 [JP] Japan ..... 4-353255
Jan. 21, 1993 [JP] Japan ..... 5-027495

[51] Int. Cl.[6] ..... D04B 17/00
[52] U.S. Cl. ..... 28/141; 19/115 R
[58] Field of Search ..... 19/25, 115 R, 218, 219, 19/223, 159 A, 235, 122, 125, 236, 300; 28/141; 57/22, 23, 261; 242/553, 556

[56] References Cited

U.S. PATENT DOCUMENTS 2,559,074 7/1951 Hinson .
4,419,791 12/1983 Schar .
5,027,475 7/1991 Mondini et al. .
5,038,441 8/1991 Mondini et al. ..... 19/115 R
5,077,865 1/1992 Mondini et al. ..... 19/115 R
5,144,731 9/1992 Sugie et al. .
5,303,453 5/1994 Langel et al. ..... 19/115 R
5,337,456 8/1994 Clement ..... 19/115 R

FOREIGN PATENT DOCUMENTS 0446354 9/1991 European Pat. Off. .
0455171 12/1991 European Pat. Off. .
0482475 4/1992 European Pat. Off. .
2401593 3/1979 France .
1292121 11/1989 Japan .
4222234 8/1992 Japan .

*Primary Examiner*—Clifford D. Crowder
*Assistant Examiner*—Larry D. Worrell, Jr.
*Attorney, Agent, or Firm*—Stevens, Davis, Miller & Mosher

[57] ABSTRACT

A method and apparatus for piecing lap sheets in a textile machine, such as a comber or ribbon lap machine. The machine is stopped when a lap roll EL is nearly emptied. A pressing member 53 at a rest position C1 is moved to an operating position C2, and a breaking comb 32 is moved from a rest position A1 to an operating position A2 so that the lap sheet LP2 is broken. A full lap FL is then rolled onto a pair of feed rollers 10 and 11. A suction pipe 43 is then moved to an operating position B1, so as to engage with an end S1 of a new lap sheet LP1 from the full lap roll FL. The suction pipe 43 is then moved to a position B3 located at a distance from a nip line N1 longer the length of the lap sheet LP1 from the nip line N1 to its edge, causing the ends of the old and new lap sheets to be superimposed. A reverse rotation of the feed rollers 10 and 11 then occurs, so that the fibers of the new lap sheet LP1 at the superimposed portion are stretched. Finally, a pressing member 53 is again moved to the operating position C2, so that the fibers at the superimposed portion are pressed toward the lap sheet plate 20 to obtain a neatly superimposed condition.

10 Claims, 7 Drawing Sheets

Fig.4-(1)
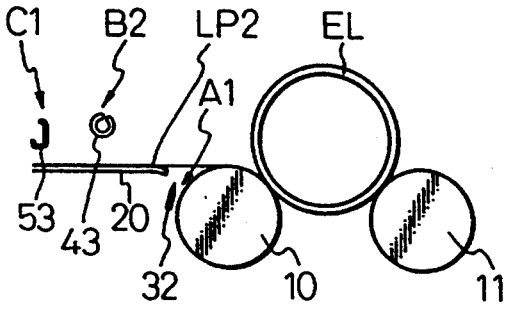
Fig.4-(2)
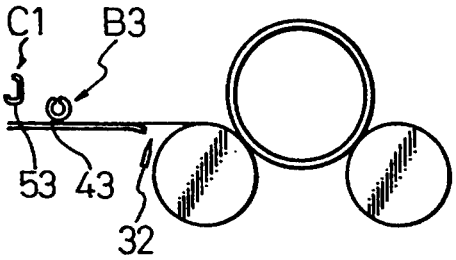
Fig.4-(3)
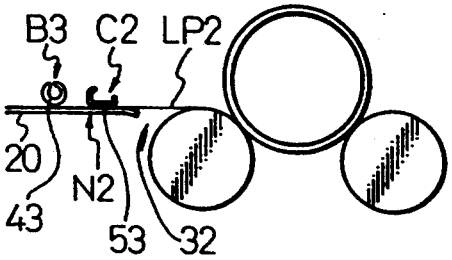
Fig.4-(4)
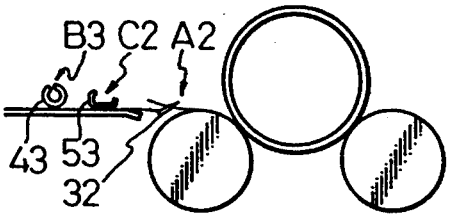
Fig.4-(5)
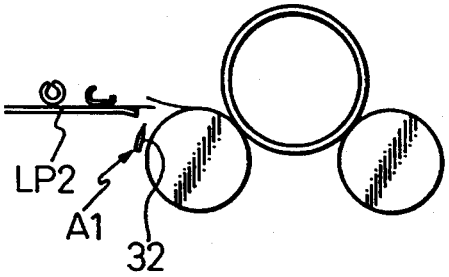
Fig.4-(6)
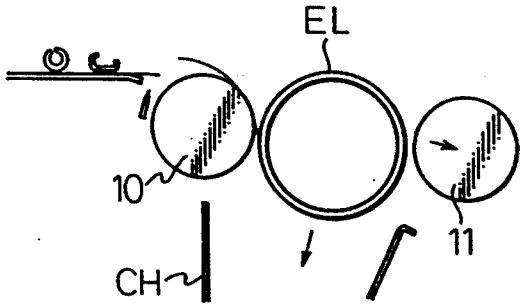

Fig.5-(1)
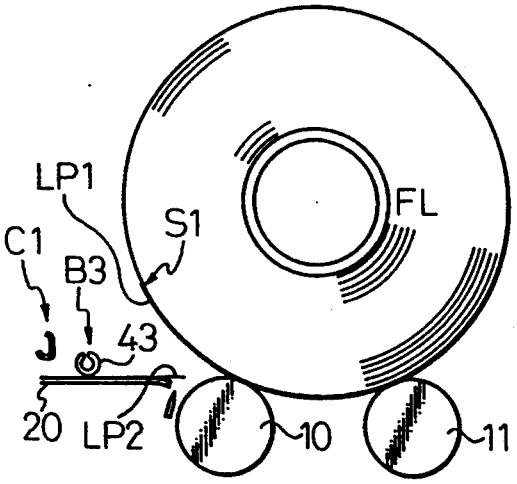
Fig.5-(2)
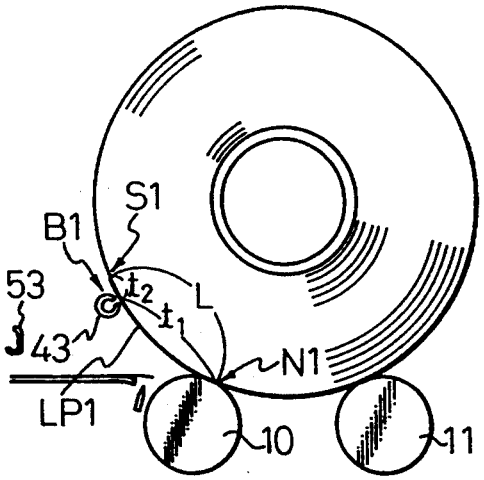
Fig.5-(3)
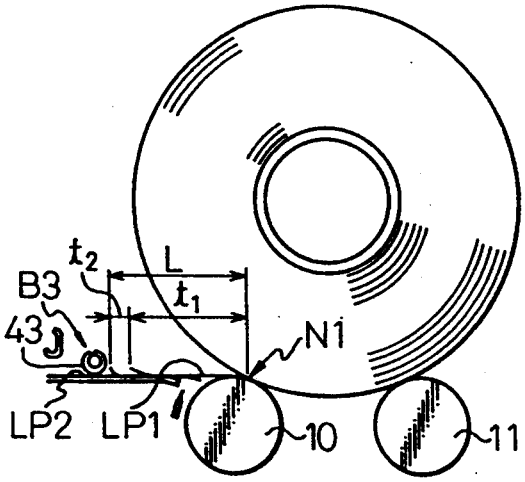
Fig.5-(4)
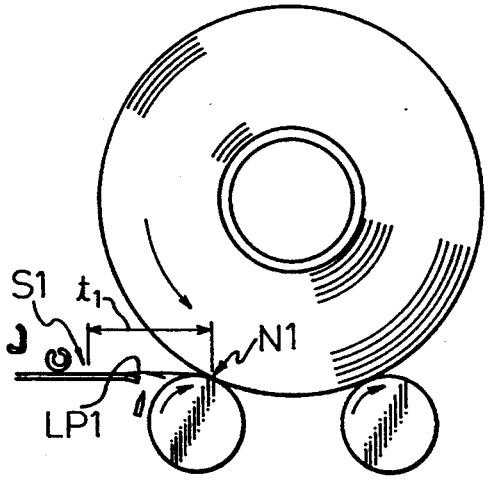
Fig.5-(5)
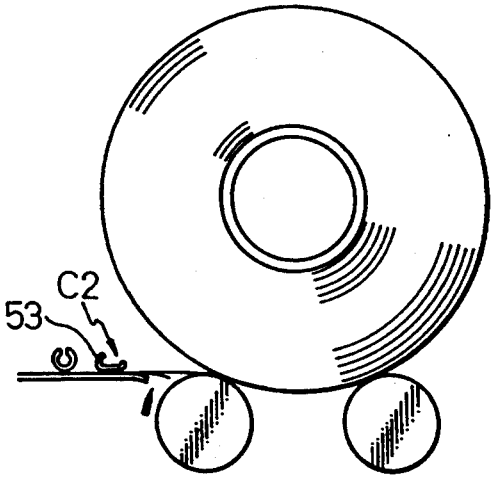
Fig.5-(6)
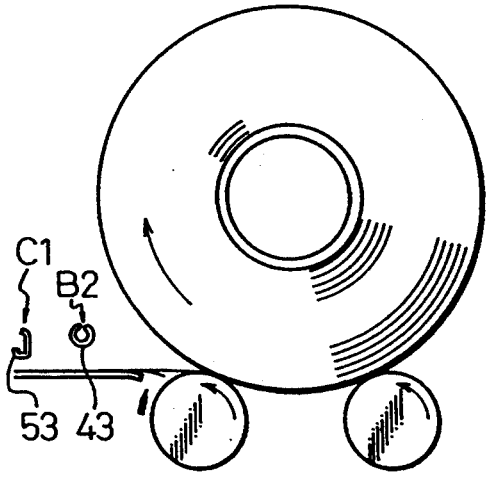

METHOD AND APPARATUS FOR PIECING LAP SHEETS

BACKGROUND OF THE INVENTION

1. Field of the Invention

The present invention relates to an method and apparatus for piecing, to a lap sheet from an almost exhausted, roll, the leading end of a lap sheet from a new lap roll. The present invention can be suitably used for a textile machine such as a comber or a ribbon lap machine.

2. Background of the Invention

U.S. Pat. No. 5,144,731 discloses an automatic lap sheet piecing apparatus. According to this prior art, a lap sheet from a new roll is placed on a pair of spaced feed rollers, and the leading end of the lap sheet is held against a suction pipe by suction. The sucked end of the new lap sheet is moved to a location above a tail end of an old lap sheet being fed to a spinning machine. Then, the suction is reduced, so that the leading end of the new lap sheet is placed on the broken end of the old lap sheet on a lap sheet plate. Then, the suction pipe (with no suction) is moved toward the lap plate to contact the superimposed portions of the lap sheets. The suction pipe is then moved horizontally, so that the two lap sheets are smoothed against each other to prevent the fibers at the superimposed ends of the old and new lap sheets from separating. In order to obtain the above-mentioned movement of the suction pipe, a supporting arm is provided, to which a rocking movement is applied from a first motor, and the supporting arm is, at its tip end, provided with a shaft, to which a rotational movement from a second motor is applied. Connected to an end of the shaft is a base end of a suction arm, which has a free end to which the suction pipe is connected.

Regarding the breakage of a tail end of a lap sheet being fed to a spinning machine, two kind of prior arts have heretofore been proposed. Namely, in U.S. Pat. No. 5,027,475, a set of carrier rolls is arrange upstream from a set of feed rollers, which cooperate with a swingable lap sheet roller for supporting a lap sheet fed to the spinning machine. When the lap roll fed to the spinning machine is nearly emptied, a swing movement of the lap roll is obtained, for causing the consumed lap roll to be exhausted to a trough, while the carrier roller are reversed for breaking the lap sheet at a location between the feed rollers and the carrier rollers. Then the lap sheet roller is swung to the upper position, which allows a full lap roll to be supported by the cooperation of the lap roll with the carrier rollers, which is followed by a piecing operation of the lap sheet from the full lap roll to the broken lap sheet to the spinning machine.

As for an alternative for the breakage of the tail end of a lap sheet, in a comber disclosed by the U.S. Pat. No. 2,559,074, an old lap sheet nearly emptied is dropped downwardly from a pair of feed rollers during the operation of the comber, while, in synchronous with the dropping of the consumed roll, a previously prepared full lap sheet on a bobbin is rested on the feed rollers. A comb is arranged below a feed roller, so that the comb cooperates with the lap from the consumed lap roll when it is dropped, which causes the lap sheet from the old lap roll to be broken.

U.S. Pat. No. 5,144,731 is disadvantageous in that the fibers are apt to be separated at the location where the end of the old lap sheet is superimposed with the end of the new lap sheet, which causes the quality of the pieced portion of the lap sheet to be reduced. In this patent, the superimposition of the ends of the old and new lap sheets is done by a horizontal movement of the suction nozzle. However, the smoothing operation thus obtained is insufficient to obtain the desired quality at the pieced portion. Furthermore, the movement of the suction pipe for the smoothing operation is obtained by the combined movements of different motors. Thus, a sophisticated control of the separate motors is required to obtain a movement of the pipe member so that the pipe member is uniformly pressed to the lap sheets to obtain a desired smoothing operation of the fibers.

Furthermore, the breaking operation of the end of the old lap roll in U.S. Pat. No. 5,027,475 is defective in that a provision for pressing the old lap roll is necessary, which causes the apparatus to be complicated. In the second prior art (U.S. Pat. No. 2,559,074), the breakage of the lap is done using the comb member acting with the lap sheet fed during the execution of the combing operation. Namely, the breakage of the lap can only be done when the combing machine is operated. In other words, breakage of the lap sheet can not be done when the combing machine is stopped.

SUMMARY OF THE INVENTION

An object of the present invention is to provide a method and apparatus capable of obtaining a reliable piecing operation without complicating its structure.

Another object of the present invention is to provide a method and apparatus capable of preventing the separation of the fibers at the superimposed end portions of the old and new lap sheets which are to be pieced.

Another object of the present invention is to provide a method and apparatus capable of obtaining a reliable breakage of a lap sheet between the roll and the spinning machine, when the spinning machine is stopped.

According to one aspect of the present invention, a method is provided for piecing lap sheets in a textile machine having a lap sheet treating means and a pair of feed rollers for feeding a lap sheet from a lap roll, said method comprising the steps of:

(a) interrupting the feed of the lap sheet by stopping the feed rollers;

(b) breaking the lap sheet between the lap sheet treating means and the front feed roller;

(c) providing a full lap roll so that the full lap roll is seated on said pair of the feed rollers;

(d) providing a suction pipe and causing the suction pipe to face a leading end of a lap sheet from the full lap roll;

(e) generating a vacuum force in the suction pipe so that the leading end of the lap sheet from the full lap roll is held by the suction pipe;

(f) displacing the suction pipe so that the leading end of the lap sheet from the full lap roll is superimposed onto the tail end of the lap sheet in the treating means, so that the length of the superimposed portion of the lap sheets is larger than a predetermined target value;

(g) rotating the feed rollers in a reverse direction, so that the length of the superimposed portions of the lap sheets is made equal to the target value, and;

(h) providing a pressing member and displacing the pressing member so that the superimposed portions of the lap sheets are pressed against each other.

According to another aspect of the present invention, an apparatus is provided, for piecing lap sheets in a textile machine, having a lap sheet treating means and a pair of back and front rollers, which are reversible, the apparatus being for piecing, to an old lap sheet, a new lap sheet from a full roll resting on the pair of the rollers, while nipping, along a nip line, the new lap sheet from the full roll between the roll itself and the front feed roller, said apparatus comprising:

a lap sheet plate on which a broken, tail end of the old lap sheet to said lap sheet treating means is located;

a suction pipe arranged at a location forward of the feed rollers, and defining a suction nozzle extending along a width of the lap sheet;

means for obtaining a reciprocating movement of the suction pipe between a third position where the suction pipe is located at a location which is spaced forward of the suction pipe at a location from said nip line longer than a length of the new lap sheet from its leading end to the nip line, and which is above the old lap sheet and a second position where the suction pipe is engaged with the leading end of the new lap sheet for holding the lap sheet by the suction nozzle;

a movement of the suction pipe from second position to the third position causing the leading end of the new lap sheet to be superimposed with the tail end of the old lap sheet;

a pressing member arranged at a location forward of the feed rollers, and;

means for obtaining a reciprocating movement of the pressing member between a first position where the pressing member is spaced from the lap sheet plate and a second position where the pressing member presses the superimposed portions of the lap sheets to the lap sheet plate to cause the old and new lap sheets to be pieced.

BRIEF DESCRIPTION OF ATTACHED DRAWINGS

FIGS. 4-(1) to (6) are schematic side views of the lap sheet feed section and illustrates, in a series of phases, a breaking operation of a lap sheet from an old lap sheet.

FIGS. 5-(1) to (6) are schematic side views of the lap sheet feed section and illustrates, in a series of phases, a lap sheet piecing operation.

Figure 6:
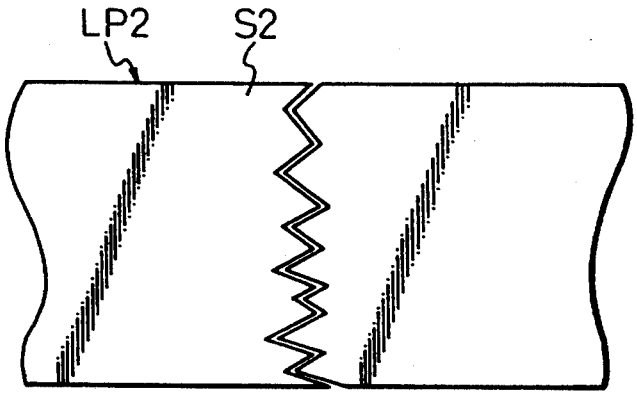

FIG. 6 illustrates how a breakage of an old lap sheet occurs along its width.

Figure 7:
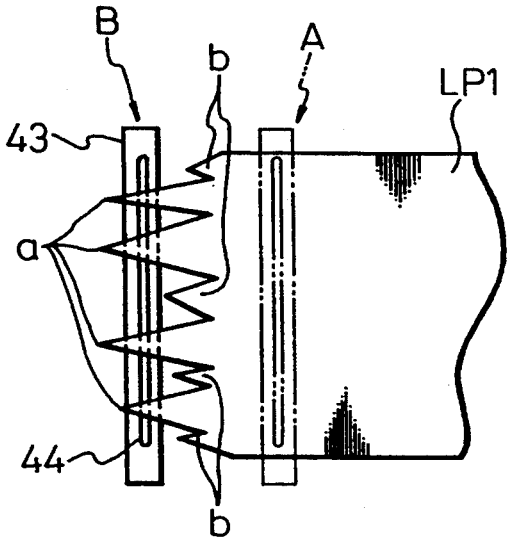

FIG. 7 is a schematic view which illustrates the relationship of a suction pipe to a leading end of a lap sheet from a full lap roll.

DESCRIPTION OF PREFERRED EMBODIMENT

Figure 1:
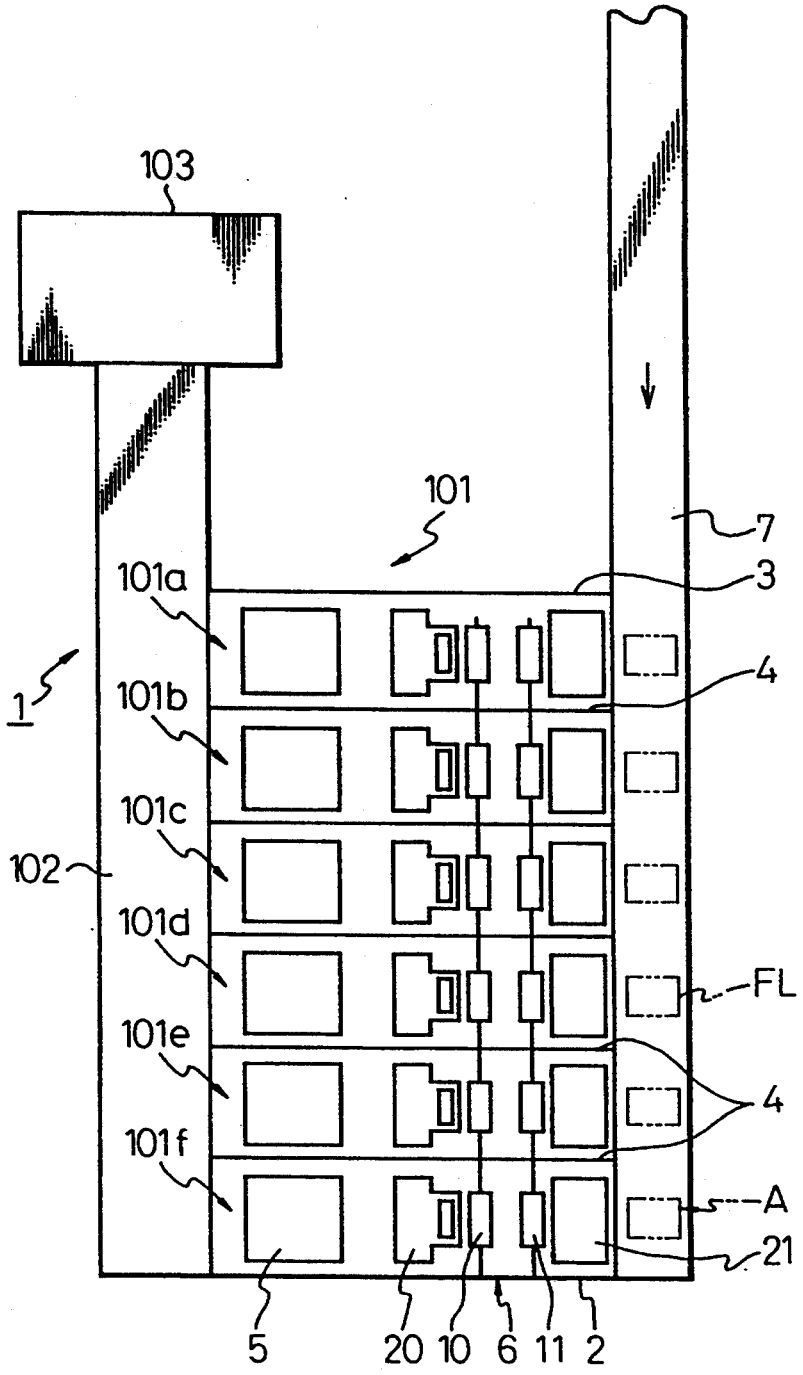
FIG. 1 is a general plan view of a ribbon lap machine, to which the present invention is applied.

Now, an embodiment of the present invention will be explained, as it is applied to a ribbon lap machine. As shown in FIG. 1, the ribbon lap machine 1 includes a lap sheet feed section 101 for feeding a plurality of lap sheets, a lap sheet formation section 102 for combined lap sheets from the supplying section 101 to create a finished lap sheet, and a winding section 103 for winding the finished sheet to a lap roll.

Figure 2:
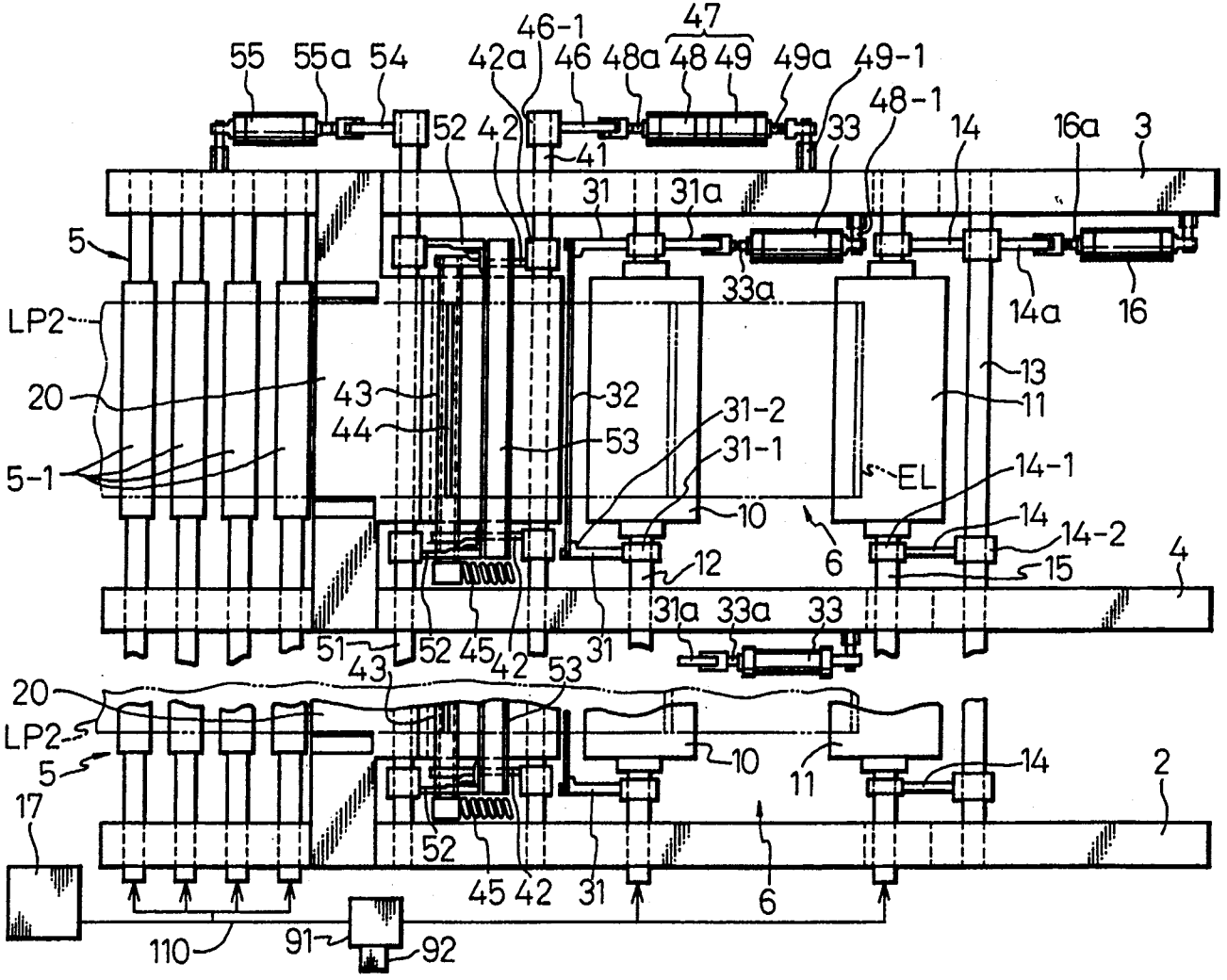
FIG. 2 is a detailed plan view of a lap sheet feed section of the ribbon lap machine in FIG. 1.

The lap sheet feed section 101 includes end frames 2 and 3, between which parallel intermediate frames 4 are arranged so that they are equally spaced with each other, so that feed parts 101*a* to 101*f* are formed between the adjacent frames 2, 3 and 4. Lap sheets from the respective lap rolls are moved along the respective feed parts 101*a* to 101*f*, while they are subjected to drafting process. These lap sheets from the feed parts 101*a* to 101*f* are combined at the lap sheet formation section 102. Each of the feed parts 101*a* to 101*f* includes a draft unit 5 which, as shown in FIG. 2 includes four spaced parallel drafting rollers 5-1, and a lap sheet feed unit 6 arranged upstream from the draft unit 5 in the direction of the supply of the lap sheet. As shown in FIG. 1, the feed parts 101*a* to 101*f* are, at their upstream ends, connected to a lap sheet feed conveyor 7, so that full lap rolls FL are conveyed to respective waiting positions A on the conveyor 7 as shown by dotted line Which are suitable for supplying the full lap rolls FL to the respective feed parts 101*a* to 101*f*.

As shown in FIG. 2, the lap sheet feed unit 6 includes a front feed roller 10 and a back feed roller 11, which are spaced in parallel with each other. The front feed roller 10 is keyed to a front feed roller shaft 12, which extends transverse to the frames 2, 3 and 4, and is rotatably supported thereby by respective bearings (not shown). The back feed roller 11 is keyed to a back feed roller shaft 15, which extends transverse to the frames 2, 3 and 4. Arranged below of the back feed roller 11 is a back feed roller swing shaft 13 (FIG. 3), which also extends transverse to the frames 2, 3 and 4, and is rotatably supported thereby. Provided axially spaced along the shaft 13 are swing levers 14 in such a manner that, as shown in FIG. 2, at each of the feed parts 101*a* to 101*f*, a pair of the swing levers are located on both side of the back roller 11 axially outwardly thereof and axially inwardly of frames 2, 3 or 4, which is located adjacent the corresponding roller 11. Each swing lever 14 has a first end 14-1, of a ring shape, which holds the back feed roller shaft 15 and is fixed thereto by suitable means, such as screws, and a second end 14-2, of a ring shape, which holds the back feed roller swing shaft 13 and fixed thereto by suitable means, such as screws.

Figure 3:
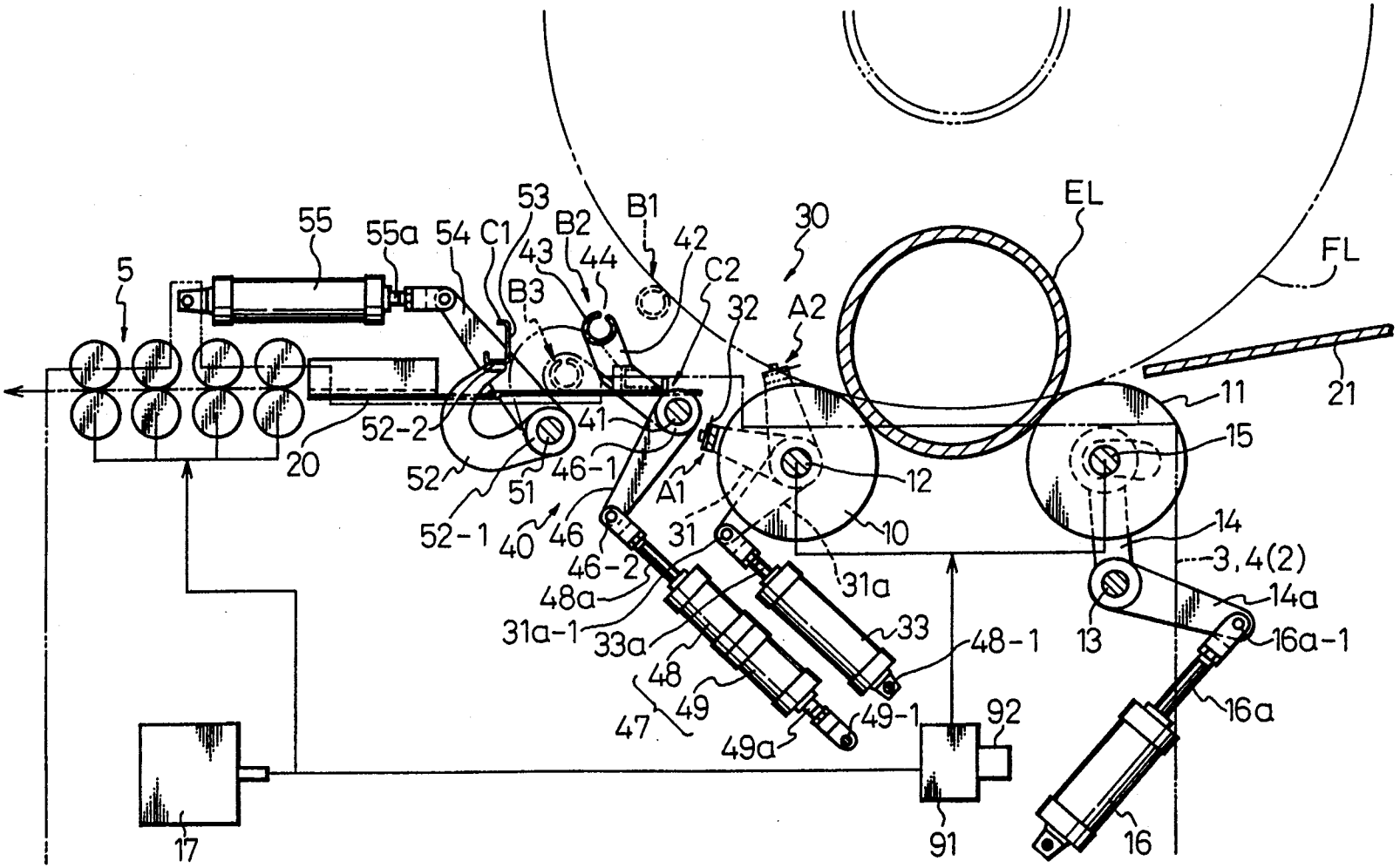
FIG. 3 is a side view of the lap sheet feed section in FIG. 2.

As shown in FIGS. 2 and 3, among the swing levers 14, the one which is the most adjacent the frame 3 has an arm portion 14*a* which extends integrally and rearwardly, to which an air cylinder 16 is pivoted at its piston rod 16*a* by means of a pin 16*a*-1. A reciprocal movement of the piston rod 16*a* causes the arm 14*a* to be reciprocally rotated about the axis of the shaft 13, which causes the swing levers 14 to be also reciprocally rotated, so that the back feed rollers 11 on the shaft 15 connected to the swing levers 14 are moved between a position where the back feed rollers 11 are located adjacent the front feed rollers 10 for feeding a lap sheet from a roll, and a position where the back feed rollers 11 are located spaced from the front feed rollers 10, so that an empty lap roll is dropped for removal.

A drive mechanism includes a Fain electric motor 17 (FIG. 2), which is connected, via a transmission system 110, to the feed rollers 10 of the lap sheet feed unit 6 and the draft rollers 5-1 of the draft unit 5, so that, during an usual lap sheet feeding operation where the main motor 17 generates its rotating movement, the rotational movement is applied to thereto for obtaining an advancing movement of the lap sheets at the respective lap sheet supplying sections 101*a* to 101*f* by the rotating movement of the rollers, while the lap sheet is subjected to a draft operation by the different speed of the rollers 5-1. As shown in FIG. 2, the transmission system 110 includes a differential gear mechanism 91 and a sub electric motor 92 connected thereto. The differential gear mechanism 91 is arranged in a portion of the transmission train for operating the feed rollers 10 and 11. Thus, upon the stoppage of the main motor 17, only the feed rollers 10 and 11 are subjected to a rotating movement, in the opposite direction to that for obtaining the advancing movement of the lap sheets. Namely, the rollers 10 and 11 are reversible.

As shown in FIGS. 2 and 3, a lap sheet plate 20 is arrange between the front feed roller 10 and the back rollers 5-1 of the draft unit 5, so that the lap sheet plate 20 extends transverse across the frames 2, 3 and 4. The lap sheet plate 20 has a plane which extends horizontally in FIG. 3. Furthermore, as shown in FIG. 1, at each location of the lap sheet supplying section 101*a* to 101*f*, where it is connected to the lap sheet feed conveyor 7, an inclined table 21, which is inclined slightly downwardly from the lap sheet supply conveyor 7 to the corresponding back roller 11 as shown in FIG. 3, is arranged, so that a full lap roll FL located at a respective waiting position A is pushed to the corresponding inclined table 21 by means a pusher mechanism (not shown), so that the lap roll FL is delivered to the corresponding lap sheet feed unit 6.

In FIG. 3, a reference numeral 30 denotes a lap sheet breaking device provided for each of the lap sheet feed units 6. Each lap sheet breaking device 30 includes comb supporting arms 31, which are, at each of the lap sheet feed units 6, arranged at the sides of the corresponding front feed roller 10 in the axial direction. Each of the arms 31 has a first end 31-1 of a ring shape, to which the front feed roller shaft 12 is rotatably inserted, and a second end 31-2, to which a lap sheet breaking comb 32 is connected. Namely, the pair of arms 31 astride a front feed roller 10 which cooperate to rotate the corresponding comb 32 about the axis of the shaft 12 between a position A1 as shown by a solid line and a position A2 as shownby a dotted line. One of the arms 31 constructing a pair forms integrally a connecting arm portion 31*a*, which has a free end pivoted, by means of a pin 31*a*-1, to a piston rod 48*a* of a lap sheet breaking cylinder 48. The cylinder 48 has a cylinder body having an end remote from the piston rod 33*a*, which is pivoted to a frame 3 or 4 by means of a pin 48-1. An operation of the cylinder 33 causes the corresponding comb supporting arms 31 together with a corresponding comb 32 to be rotated between the first, waiting position A1 where the comb 32 is located below a corresponding lap sheet LP2 and the second, operating position A2 where the lap sheet LP2 is broken.

Reference numeral 40 indicates a lap sheet piecing device, which is arranged for each of the lap sheet feed units 6. The lap sheet piecing device 40 includes a suction pipe 43 and a pressing member 53. As shown in FIG. 2, a pipe supporting shaft 41 extends transversely, to which pairs of pipe supporting arms 42, each having integral ring shaped first end portion 42*a*, are inserted and fixed by means of screws. The pipe supporting arms 42 are arranged as pairs. Namely, both arms 42 of each pair are axially spaced so that the lap sheet LP2 is moved between the supporting arms. The arms 42 in each pair have second ends, to which the suction pipe 43 is connected so that it extends transversely. The suction pipe 43 forms an elongated slit 44 of a width corresponding to that of a lap sheet LP2. The suction pipe 43 is in communication with a not shown suction source (vacuum pump) via a corresponding flexible hose 45.

As shown in FIG. 2, the pipe supporting shaft 41 has one end projected out of the frame 3, to which a swing arm 46 is fixedly connected at its one end 46-1. The other end of the swing arm 46 is connected to a pipe swing cylinder assembly 47. The pipe swing assembly 47 is constructed of first and second cylinders 48 and 49 which are connected in a back to back relationship with each other. Namely, the first cylinder 48 has a piston rod 48*a* pivoted to the swing arm 46 by mean of a pin 46-2. The cylinder portion of the first cylinder 48 is connected to a cylinder portion of the second cylinder 49. The second cylinder has a piston rod 49*a* pivoted to the frame 3 by means of a pin 49-1.

An energization of the cylinders 48 and 49 causes the piston rods 48*a* and 48*b* to be reciprocated, so that the arm 46 is rotated through an angle, so that the suction pipe 43 moves along an arc shaped trajectory. Namely, when both of the piston rods 48*a* and 48*b* are extended, the suction pipe 43 is in a second position B1, where the suction pipe 43 can hold the leading end S1 (FIG. 5) of a lap sheet at the outermost periphery of a full lap roll FL. Contrary to this, when both of the piston rods 48*a* and 48*b* are retracted, the suction pipe 43 is in a third position B3 in FIG. 3, where the suction pipe 43 is far away from the full lap roll FL. Furthermore, when the piston rod 48*a* is extended, while the piston rod 49*a* is retracted as shown by solid lines in FIG. 3, the suction pipe 43 is located at an first position or rest position B2 between the second and third positions B1 and B3.

At the open position B3, as shown in FIG. 5-(1) and (3), the suction pipe 43 is located at a position away from a nip line N1 of the front feed roller 10 with the full lap roll FL and toward the direction of the draft unit 5 at a distance longer than the length L of the lap sheet between the nip line N1 and the leading end S1 of the lap sheet from the full lap roll FL, and where the suction pipe 43 presses a preceding (old) lap sheet LP2 from above. As will be explained later, the length L of the lap sheet is a length $t_1$ to obtain a target length of the superimposed portions of ends of old and new lap sheets, plus a rewinding length $t_2$ which is the length of the lap sheet wound by a reverse rotation of the feed rollers 10 and 11 during a lap sheet piecing operation.

As shown in FIGS. 2 and 3, a shaft 51 extends transversely across the frames 2, 3 and 4 at a location forward of the shaft 41 and is rotatably supported by the frames. Fixedly connected to the shaft 51 are an axially spaced pair of supporting arms 52. The pair of supporting arms 52 are located on the shaft 51 so that they are axially spaced while the corresponding lap sheet LP2 moves between the arms 52. Connected to the pair of the arms 52 are a pressing member 53 which extends axially. As shown in FIG. 3, the supporting arm 52 substantially U-shaped, which prevents the arms 52 from interfering with the suction pipe 44 which is located at the opened position B3 as shown by the dotted line. The supporting arm 53 has a first end 52-1 fixedly connected to the shaft 51 and a second end 52-2 to which the corresponding pressing member 53 is fixedly connected. The pressing arm 53 functions to press the ends LP1 and LP2 of the new and old lap sheets, respectively, with respect to the lap sheet plate 20. As shown in FIG. 2, the shaft 51 has an end which extends from the plate 3, so that a rocking lever 54 at its one end is connected to the end of the shaft 51. The rocking lever 54 has a second end, to which a piston rod 55*a* of a cylinder 55 is connected. The cylinder 55 is for reciprocating the pressing member 53 along an arc shaped trajectory between a waiting or rest position C1 vertically spaced from the lap sheet plate 20 and an operating position C2 where the superimposed ends of the old and new lap sheets is pressed to the lap sheet plate 20. Furthermore, the suction pipe 43 and the pressing member 53 function, also, for nipping the lap sheet when it is broken.

Now, an operation of the device according to the present invention will be explained.

During the operation of the machine, the suction pipe 43 and the pressing member 53 are, as shown in FIG. 4-(1), in the rest positions B2 and C1, respectively, so as not to interfere with the lap sheet LP2 moving from the lap roll EL to the corresponding drafting unit 5. A sensor (not shown) is provided for detecting a condition, where an old lap roll EL on the feed rollers 10 and 11 is nearly empty. The sensor is of, for example, a type to detect a predetermined length of the lap sheet unwound from the roll EL. Upon the detection of the nearly empty state of the old lap roll EL, the machine is stopped. Then, the suction pipe 43, from the position B2 in FIG. 4-(1), is moved to the position B3 in FIG. 4-(2), and the pressing member 53 is, from the position C1 in FIG. 4-(2), rocked to the position C2 as shown in FIG. 4-(3). As a result, the lap sheet LP2 from the nearly emptied roll EL is nipped between the suction pipe 43 as well as the passing member 53 and the lap sheet plate 20. A nip point of the lap sheet LP2 between the pressing member 53 and the lap plate 20 is designated by N2. Then, a movement of the comb 32 along the arc shaped trajectory is obtained, so that the comb 32 is, from the waiting position A1 in FIG. 4-(1), moved upwardly and away from the nipping point N2 to the position A2 in FIG. 4-(4). As a result of the upward movement of the comb 32, the lap sheet LP2 from the consumed lap roll EL is displaced upwardly, which causes it to be broken. The breakage of the end of the lap sheet LP1 is done by the fact that the fibers are displaced from each other at separate locations along the width of the lap sheet as illustrated in FIG. 6.

The comb 32 is, then, from the position A2 in FIG. 4-(4), returned to the position A1 in FIG. 4-(5), so that the lap sheet breaking operation is finished. Then, the cylinder 16 (FIG. 3) is operated so that the piston rod 16*a* is retracted, which causes the arms 14 holding the back feed roller 11 to be swung about the axis of the shaft 13, so that the back feed roller 11 is moved away from the front feed roller 10, as shown in FIG. 4-(6). As a result, the nearly emptied lap roll EL is dropped via the space between the rollers 10 and 11 to a chute CH.

Prior to a piecing operation, full lap rolls FL from the preceding station or process are, as shown in FIG. 1, already conveyed to the waiting positions A corresponding to the respective draft units 5 of the supplying sections 101*a* to 101*f*. An indexing device (not shown), which is known, is provided at the preceding station (not shown), so that, at each of the waiting stations A, the full lap roll FL is located in such a manner that the front leading end S1 of the full lap roll FL is located at a predetermined angular position about the axis of the roll. At each of the waiting stations A, a pusher lever (not shown) is provided for ejecting a full lap roll FL at the corresponding waiting position A onto the corresponding inclined table 21, so that the full lap roll FL can be rolled on the table 21 to a position as shown FIG. 5-(1), where the full lap roll FL is seated on the corresponding pair of the front and back feed rollers 10 and 11. Due to the predetermined angular position of the leading end S1 of the full lap roll at the waiting position A, the full lap roll is, after rolled to the position in FIG. 5-(1), located so that the leading end S1 of the lap sheet LP1 is facing the suction pipe 43 when it is rotated to the position B1 as shown in FIG. 5-(2).

Next, a lap sheet piecing operation is commenced. Due to the fact that the leading end S1 of the lap sheet is located at a predetermined angular position by means of the indexing device (not shown), a movement of the suction pipe along the arc shaped trajectory from the position B3 in FIG. 5-(1) to the position B1 in FIG. 5-(2) causes the suction pipe 43 to contact the leading end S1 of the lap sheet from the full lap sheet FL, whereby the leading end S1 of the lap sheet is sucked by the suction nozzle 44 (FIG. 3) of the suction pipe 43. FIG. 7 illustrates variations A and B as to possible positions of engagement of the suction pipe 43 to the leading end of the lap sheet LP1 from the full lap roll FL. At the broken end of the lap sheet LP1 from a full lap roll FL, the separation of fibers upon the breakage of the lap sheet occurs unevenly along the width of the lap sheet LP1. As a result, the lap sheet LP1 has projected portions a of fibers of an increased length and projected portions b of fibers of a reduced length, while these portions a and b are arranged randomly along the width the lap sheet LP1.

The piston rods 48*a* and 49*a* of the cylinders 48 and 49, respectively, are retracted, so that the suction pipe 43 is returned, along the arc shaped trajectory, from the position B1 in FIG. 5-(2) to the position B3 in FIG. 5-(3), while the leading end S1 of the lap sheet is held by the suction pipe 43, so that the lap sheet is pulled from the lap roll for a length of L from the nipping line N1 between the lap roll and the front feed roller 10. The position B3 of the suction pipe 43 is located nearer to the drafting unit 5 so that the suction pipe 43 is spaced further from the nip line N1 for a length longer than the stripped out length L of the lap sheet LP1. As a result, the movement of the suction pipe 43 to the position B3 finally causes the leading end S1 of the lap sheet LP1 to be detached from the nozzle 44 of the suction pipe 43 irrespective of the vacuum force applied to the lap sheet from the suction pipe 43. Thus, the leading end S1 of the new lap sheet LP1 is moved down to the tail end of the old lap sheet LP2, so that the end of the new lap sheet is superimposed on the old lap sheet.

When the position of the suction pipe 43 with respect to the leading end of the lap sheet LP1 is as shown by A in FIG. 7 at the preceding position in FIG. 5-(2) the suction pipe 43 can hold the end of the lap sheet LP1 including both of the projected portions a and b at the broken end of the lap sheet LP1. In this case, a neatly superimposed condition between the leading end of the new lap sheet LP1 and the tail end of the old lap sheet LP2 is obtained at the phase in FIG. 5-(3). However, when the position of the suction pipe 43 with respect to the end of the lap sheet is as shown by B in FIG. 7 at the phase in FIG. 5-(2), the end of the lap sheet LP1 only including the projected portions a of an increased length is held, so that projected portions b of a reduced length are apt to be dropped under the effect of the gravity due to the fact that the suction is released earlier. Thus, a situation may arise that, at the superimposed condition between the ends of the old and new lap sheets, the fibers at the end of the new lap sheet are partially lifted with respect to the fibers of the old lap sheet, which causes the piecing operation to be imperfect. A press means as disclosed in U.S. Pat. No. 5,144,731 can be used so that the superimposed ends of the old and new laps is pressed toward each other. However, this operation is insufficient to obtain a desired, neatly superimposed condition.

According to the present invention, in order to obviated this problem in the prior art, the sub-motor 92 is operated for a predetermined time, so that the feed rollers 10 and 11 are reversed, so that a predetermined length of $t_2$ of the lap sheet LP1 is wound on the lap roll EL. Such a reverse movement of the lap sheet LP1 causes a frictional force to be generated in the fibers at the superimposed portions at the ends of the old and new lap sheets LP1 and LP2, so that the fibers at the end of the new lap sheet LP2 are rearwardly stretched, so that the lifted fibers at the end of the lap sheet LP1 are stretched, so as to cause them to come into face to face contact with the fibers at the end of the old lap sheet LP2. As a result, a neatly superimposed condition of the ends of the old and new lap sheets LP1 and LP2 is obtained, while the length of the superimposed ends are equal to the target value. In this state, as shown in FIG. 5-(4), the length of the lap sheet LP1 from the nip portion N1 to the end S1 is equal to the predetermined value $t_1$.

Then, as shown in FIG. 5-(5), the pressing member 53 is moved to the position C2, which causes the superimposed portions of the lap sheets LP1 and LP2 to be pressed from the above to the lap sheet plate 20, which causes the ends of the lap sheets to be positively pieced. Then, as shown in FIG. 5-(6), the pressing member 53 and the suction pipe 43 are moved to the waiting positions C1 and B2, respectively. Then, the machine is re-started.

According to the embodiment as explained, upon the breaking of the lap sheet as shown in FIG. 4-(4), in addition to the pressing member 53 located at the position C2, the suction pipe 43 located at position B3 operates, also, to nip the lap sheet with respect to the lap sheet plate 20. However, as a modification, it is possible to construct so that only the pressing member 53 operates to nip the lap sheet.

Furthermore, in the shown embodiment, the suction pipe 43 is constructed to take three position B1, B2 and B3. However, the waiting position B2 may be identical to the opened position B3, where the suction pipe 43 is positioned so that it is slightly spaced from the lap sheet plate 20, so that the passage of the lap sheet is allowed.

Furthermore, during the piecing operation, after the superimposition of the ends of the old and new lap sheets and prior to the reverse rotation of the feed rollers 10 and 11, the ends of the both of the ends of the sheets are gently pressed by a press member 53 having a smooth pressing surface, and the feed rollers are reversed, so that the new lap sheet is rearwardly stretched to remove the lifted condition of that portion of the fibers.

We claim:

1. A method for piecing lap sheets in a textile machine having a lap sheet treating means and a pair of feed rollers for feeding a lap sheet from a lap roll, comprising the steps of:

(a) interrupting the feed of the lap sheet by stopping the feed rollers;

(b) breaking the lap sheet between the lap sheet treating means and one roller of the pair of feed rollers located forwardly in the direction of feeding of the lap;

(c) providing a full lap roll so that the full lap roll is seated on said pair of the feed rollers;

(d) providing a suction pipe and positioning the suction pipe to face a leading end of a lap sheet of the full lap roll;

(e) generating a vacuum force in the suction pipe so that the leading end of the lap sheet from the full lap roll is held by the suction pipe;

(f) displacing the suction pipe so that the leading end of the lap sheet from the full lap roll is superimposed onto the tail end of the lap sheet to the treating means, so that a length of the superimposed portion of the lap sheets is larger than a predetermined target value;

(g) rotating the feed rollers in a reverse direction, so that the length of the superimposed portion of the lap sheets is equalized to the target value, and;

(h) providing a pressing member and displacing the pressing member so that the superimposed portions of the ends of the lap sheet are pressed against each other.

2. A method according to claim 1, wherein said breaking in step (b) comprises the steps of:

(i) providing a lap sheet plate for resting thereon an old lap sheet to the treating means;

(j) displacing the pressing member toward the lap sheet plate so that the old lap sheet is nipped between the pressing member and the lap sheet plate at a location between the lap roll on the pair of the feed rollers and the lap sheet treating means;

(k) providing a breaking comb extending along the width of the lap sheet, which is usually in a waiting position spaced from the lap sheet on one side along the thickness thereof, and;

(l) displacing the breaking comb toward a breaking position where the breaking comb is engaged with the nipped lap sheet, thereby breaking the old lap sheet.

3. Method according to claim 2, wherein said breaking further comprises a step of moving the suction pipe toward the lap sheet plate so that the old lap sheet is nipped between the suction pipe and the lap sheet plate at a location between the location of the nipping by the pressing member and the lap sheet treating means.

4. An apparatus for piecing lap sheets in a textile machine having a lap sheet treating means and a pair of back and front rollers, which are mounted for reversible rotation, the apparatus being for piecing, to an old lap sheet, a new lap sheet from a full roll resting on the pair of rollers, while nipping, along a nip line, the new lap sheet from the full roll between the roll itself and the front feed roller, said apparatus comprising:

a lap sheet plate on which a broken, tail end of the old lap sheet to said lap sheet treating means is located;

a suction pipe arranged at a location forward of the feed rollers, and defining a suction nozzle extending along a width of the lap sheet;

a means for reciprocating the suction pipe between a first position where the suction pipe is located at a distant location from said nip line in the direction of the feeding of the lap which is longer than a length of the new lap sheet from its leading end to the nip line and which is above the old lap sheet, and a second position where the suction pipe is engaged with the leading end of the new lap sheet for pulling the lap sheet by the suction nozzle;

a movement of the suction pipe from said second position to the first position causing the leading end of the new lap sheet to be superimposed on the tail end of the old lap sheet;

a pressing member arranged on a location forward of the feed rollers in the direction of the feeding of the lap, and;

means for reciprocating the pressing member between a first position where the pressing member is spaced away from the lap sheet plate and a second position where the pressing member presses the superimposed portions of the lap sheets against the lap sheet plate to cause the old and new lap sheets to be pieced.

5. A textile machine according to claim 4, further comprising means for moving the suction pipe toward the lap sheet plate so that the old lap sheet is nipped between the suction pipe and the lap sheet plate at a location between the nipping by the pressing member and the lap sheet treating means.

6. A textile machine comprising:

a lap sheet treating means;

a pair of back and front rollers for supplying a lap sheet from a lap roll to said lap sheet treating means;

the lap roll resting on the pair of rollers, while nipping, along a nip line, the lap sheet from the roll between the roll itself and the front feed roller:

a lap sheet plate on which the lap sheet from the lap roll moves to the treating means;

a suction pipe arranged at a location forward of the feed rollers in the direction of the feeding of the lap, and defining a suction nozzle extending along a width of the lap sheet seat, the suction pipe being normally located at a first, rest position;

a pressing member, arranged at a location forward of the feed rollers in the direction of the feeding of the lap, which extends along the width of the lap sheet, the pressing member being normally located at its first, rest position;

means for detecting when the lap roll is consumed to stop feeding of the lap sheet to the treating means;

means, upon the detection of the consumed condition, for breaking the lap sheet from the consumed lap roll to the lap sheet treating means;

means for feeding a new, full lap roll to the pair of feed rollers, in such a manner that a leading end of a lap sheet from the full lap roll is a predetermined circumferential distance from said nip line;

means for moving the suction pipe, from the rest position, along an arc shaped path, to an operating position, wherein the suction pipe is engaged with the leading end of the new lap sheet for holding the lap sheet by the suction nozzle;

means for moving the suction pipe to a third position adjacent the lap sheet plate spaced forward from the front feed roller, so as to cause the leading end of the new lap sheet to be superimposed on the tail end of the old lap sheet on the lap sheet plate, and;

means for moving the pressing member to the operating position so that the superimposed portions of the ends of the lap sheets are pressed against the lap sheet plate, thereby causing the lap sheets to be pieced together, and allowing a spinning operation to be resumed.

7. A textile machine according to claim 6, wherein said breaking means comprises:

a breaking member arranged on one side of the lap sheet, the breaking member extending along the width of the lap sheet, the breaking member being normally located at its first, rest position;

means, upon the detection of the consumed condition and after the stoppage of the machine, for moving the pressing member from the rest position to an operating position where the lap sheet is nipped between the pressing member and the lap sheet plate, and;

means, upon the nipping of the end of the lap sheet by the pressing member, for moving the breaking member to an operating position where it engages with the lap sheet at a location adjacent the roll, thereby causing the old lap sheet to be broken and allowing the consumed lap sheet to be removed from the feed rollers.

8. A textile machine according to claim 7, wherein said breaking member comprises a comb extending along a width of a lap sheet, and means for mounting the comb rotatably about an axis which is in parallel with the axis of the feed rollers.

9. A textile machine according to claim 6, wherein said third position of the suction pipe is such that the suction pipe is spaced forwardly from the front feed roller location at distance from said nip line which is longer than the length of the new lap sheet from its leading end to the nip line, said textile machine further comprising means for rotating the feed rollers in a reverse direction when the leading end of the new lap sheet is superimposed on the tail end of the old lap sheet, so that the length of the superimposed portion of the lap sheets is made substantially the same as the target value.

10. A textile machine comprising:

a lap sheet treating means;

a pair of back and front rollers for supplying a lap sheet from a lap roll to said lap sheet treating means;

the lap roll resting on the pair of rollers, while nipping, along a nip line, the lap sheet from the roll between the roll itself and the front feed roller:

a lap sheet plate on which the lap sheet from the lap roll moves to the treating means;

a suction pipe arranged at a location forward of the feed rollers in the direction of the feeding of the lap, and defining a suction nozzle extending along the width of the lap sheet plate, the suction pipe being normally located in its first, rest position;

a pressing member arranged at a location forward of the feed rollers in the direction of the feeding of the lap, which extends along the width of the lap sheet, the pressing member being normally located in its first, rest position;

a breaking comb arranged on one side of the lap sheet, the breaking comb extending along the width of the lap sheet, the breaking comb being usually in its first, rest position;

means for detecting a condition where the lap roll is consumed, which allows the feeding of the lap sheet to the treating means to be stopped;

means for moving the pressing member upon the detection of the consumed condition, from the rest position to an operating position where the lap sheet is nipped between the pressing member and the lap sheet plate;

means whereby, upon the detection of the consumed condition, for moving the breaking comb to an operating position when it engages with the lap sheet at a location adjacent the roll, thereby causing the old lap sheet to be broken and allowing the consumed lap sheet to be removed from the feed rollers;

means for feeding a new, full lap roll to the pair of the feed rollers, in such a manner that the leading end of a lap sheet of the full lap roll is at a predetermined circumferential distance from said nip line;

means for moving the suction pipe, from the rest position, along an arc shaped path, to an operating position where the suction pipe is engaged with the leading end of the new lap sheet for holding the lap sheet;

means for moving the suction pipe to a third position where the suction pipe is spaced forward from the front feed roller location by distance longer than the length of the new lap sheet from its leading end to the nip line, which causes the leading end of the new lap sheet to be superimposed on the tail end of the old lap sheet;

means for rotating the feed rollers in a reverse direction, so that the length of the superimposed portion of the lap sheets is made substantially the same as the target value, and;

means for moving the pressing member so that the superimposed portions of the ends of the lap sheets are pressed to the lap sheet plate, thereby causing the lap sheets to be pieced with each other, and allowing the spinning operation to be resumed.

* * * * *